US011428396B2

(12) United States Patent
Kalliche

(10) Patent No.: US 11,428,396 B2
(45) **Date of Patent: *Aug. 30, 2022**

(54) LED LIGHT STRIP WITH TERMINAL BLOCK CONNECTOR

(71) Applicant: Gregory Kalliche, Brooklyn, NY (US)

(72) Inventor: Gregory Kalliche, Brooklyn, NY (US)

(73) Assignee: GJAK, LLC, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,781

(22) Filed: May 21, 2021

(65) Prior Publication Data

US 2021/0302014 A1 Sep. 30, 2021

Related U.S. Application Data

(63) Continuation-in-part of application No. 16/835,997, filed on Mar. 31, 2020, now Pat. No. 11,043,762.

(51) Int. Cl.

| | |
|---|---|
| ***F21V 23/06*** | (2006.01) |
| ***F21S 4/28*** | (2016.01) |
| ***H01R 12/57*** | (2011.01) |
| ***H01R 4/36*** | (2006.01) |
| *F21Y 103/10* | (2016.01) |
| *F21Y 115/10* | (2016.01) |

(52) U.S. Cl.

CPC ..... *F21V 23/06* (2013.01); *F21S 4/28* (2016.01); *H01R 4/363* (2013.01); *H01R 12/57* (2013.01); *F21Y 2103/10* (2016.08); *F21Y 2115/10* (2016.08)

(58) Field of Classification Search

CPC .... F21V 23/06; F21V 23/005; G09F 13/0404; H05K 1/184; F21Y 2103/10; F21Y 2115/10; H01R 9/18; H01R 9/24; H01R 13/621

See application file for complete search history.

(56) References Cited

U.S. PATENT DOCUMENTS

| | | | | | |
|---|---|---|---|---|---|
| 2,998,589 | A * | 8/1961 | Kulka | H01R 9/16 | 439/709 |
| 3,164,709 | A * | 1/1965 | Gentile | H01R 9/2433 | 200/281 |
| 4,070,086 | A * | 1/1978 | Trafford | H01R 4/363 | 439/717 |
| 4,171,152 | A * | 10/1979 | Geiseler | H05K 3/306 | 439/752 |
| 4,669,806 | A * | 6/1987 | Fuchs | H01R 4/363 | 439/712 |
| 5,848,837 | A * | 12/1998 | Gustafson | F21V 31/04 | 362/235 |
| 6,146,212 | A * | 11/2000 | Kipnik | H01R 12/515 | 439/709 |

(Continued)

*Primary Examiner* — Ismael Negron

(74) *Attorney, Agent, or Firm* — Malloy & Malloy, P.L.; Robert M. Downey

(57) ABSTRACT

An LED light strip includes a plurality of LEDs provided at regularly spaced intervals on a printed circuit board (PCB), and a screw-in terminal connector with at least two ports provided at opposite ends of the PCB and electrically connected to the plurality of LEDs for allowing the LED light strip to be connected to a power source, a data source, additional LED light strips, as well as other DC powered components via wire conductors.

1 Claim, 9 Drawing Sheets

(56) References Cited

U.S. PATENT DOCUMENTS

| | | | | |
|---|---|---|---|---|
| 7,029,336 | B2 * | 4/2006 | Cox | H01R 4/38 439/709 |
| 7,074,054 | B2 * | 7/2006 | Mertz | H01R 9/24 439/78 |
| 7,285,019 | B2 * | 10/2007 | Sakai | H01R 12/58 439/620.09 |
| 7,347,739 | B2 * | 3/2008 | Cox | H01R 4/38 439/709 |
| 7,411,174 | B2 * | 8/2008 | Eash | F21S 4/28 250/221 |
| 8,262,250 | B2 * | 9/2012 | Li | F21V 23/06 362/219 |
| 8,714,772 | B1 * | 5/2014 | Levante | F21V 19/003 362/217.17 |
| 9,004,717 | B2 * | 4/2015 | Ratkus | F21V 3/0625 362/222 |
| 10,378,747 | B1 * | 8/2019 | Hanslip | F21S 4/24 |
| 10,591,114 | B1 * | 3/2020 | Lassen | F21K 9/20 |
| 11,043,762 | B1 * | 6/2021 | Kalliche | H01R 4/36 |
| 2010/0081341 | A1 * | 4/2010 | Wu | H01R 12/7052 439/709 |
| 2011/0294363 | A1 * | 12/2011 | Yeh | H01R 9/24 439/709 |

* cited by examiner

LED LIGHT STRIP WITH TERMINAL BLOCK CONNECTOR

This non-provisional patent application is a Continuation-In-Part application of co-pending non-provisional patent application Ser. No. 16/835,997 filed Mar. 31, 2020.

BACKGROUND OF THE INVENTION

Field of the Invention

The present invention relates generally to LED light strips and, more particularly, to LED light strips having screw-in terminal connectors at opposite ends to allow for temporary or permanent connections to a DC power source, a data source or additional LED lighting strips using interconnecting wire conductors.

Discussion of the Related Art

Light Emitting Diode (LED) lighting has become increasingly popular in both residential and commercial lighting applications. In particular, Light Emitting Diode (LED) tape lighting or LED light strips are very popular for use in many types of lighting applications, including in the field of visual arts and accent lighting. For example, LED light strips are extremely common for use in accent light applications such as, but not limited to, under cabinet lighting, TV back lighting, staircase lighting, architectural lighting, as well as kitchen and bar lighting.

LED light strips are typically formed with a flexible or rigid material, such as a silicon substrate. A long printed circuit board (PCB) extends over the entire length of the strip and is incorporated into the body of the flexible or rigid material. The PCB includes conductive tracks for powering LEDs that are arranged at regular spaced intervals along the length of the strip. Conductive contact pads, such as copper pads, serve as contact terminals and are provided at predetermined intervals along the length of the strip in electrical connection with the conductive tracks. When an LED light strip is cut to a desired length, there needs to be an arrangement of at least two contact terminals pads (i.e., + and −) at each end of the light strip.

In order to power the LEDs on the light strip, it is necessary to connect the contact terminals to a DC power source which is typically a 12 volt power source or a 24 volt power source. Additionally, LED light strips can be connected to one another or other DC LED lighting connections. This requires electrical connection to the copper pads at the ends of the LED light strips. Typically, LED light strips are connected to one another by connecting the positive (+) and negative (−) conductive contact terminal pads at the end of one light strip to the corresponding positive (+) and negative (−) conductive contact terminal pads at the end of another light strip. In addition to LED light strips that have two conductive contact terminal pads, there are also LED light strips that have three, four or five conductive contact terminal pads at each end of the light strip. For instance, there are LED light strips that have three contact terminal pads at each end of the light strip, one for positive (+), one for negative (−) and one for data. A very common LED light strip is the RGB LED that has four contact terminal pads at each end, one for positive (+) and three for RGB (i.e., Red, Green, Blue) respectively in order to control and vary the color of the LEDs on the light strip. There are also LED light strips that have the addition of a white LED combined with the RGB LED. In this instance, the LED light strip has five contact terminal pads at each end, one for positive (+), three for RGB and one for the white LEDs on the light strip. When these same types of LED light strips are connected to one another, the corresponding contact terminal pads at one end of a light strip must be electrically connected to the corresponding contact terminal pad on the adjacent LED light strip.

Providing a reliable connection of wire conductors to LED light strips, for connecting the light strips to one another or to a DC power source, has proven to be problematic. In the past, others have soldered wires, such as 18-22 AWG wire, directly to the conductive terminal contact pads. The issue with the wires that come soldered on the LED strip tape from the factory is they don't offer any flexibility with how many connections you can make off of them. Also, the length they connect to other strips/power sources is limited (usually around 4-6"). It is set/predetermined and only at each end of the 16.5' roll. For this reason, they are very limited for interconnect-ability. Others have proposed various clip connectors or clamp devices that clamp to the terminal contact pads at the ends of the LED light strips. These various connection devices have been found to be unreliable. Moreover, these types of connectors often scrape or damage the terminal contact pads on the LED light strips and lose connection over time. Still others have proposed connector devices that use screws or metal pins that puncture the LED light strip at the terminal connector pads. These types of connections make destructive edits to the LED terminal connector pads that can ruin or even break the internal circuit on the PCB of the LED light strip. Moreover, most of the proposed connection devices in the related art do not offer any possibility of splitting off with multiple wire connections from the end of one LED light strip to two or more LED light strips and/or a DC power supply source.

SUMMARY OF THE INVENTION

The present invention is directed to an LED light strip with screw-in terminal connectors at opposite ends of the light strip. The LED light strip includes a flexible or rigid material substrate having a top side and a bottom side, an arrangement of LEDs at regularly spaced intervals on the top side, and a printed circuit board (PCB) with conductive tracks incorporated within the material substrate and electrically connected to the arrangement of LEDs. Conductive contact pads are provided at predetermined intervals along the length of the LED light strip. Additionally, screw-in terminal connectors are permanently attached to opposite ends of the LED light strip by soldering pins of the terminal connectors to the corresponding conductive contact pads to allow for temporary or permanent connections to a DC power supply and possibly a data source or multiple other DC LED lighting connections.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

The LED light strip of the present invention is shown in the accompanying drawings and is generally indicated as 10.

Figure 3A:
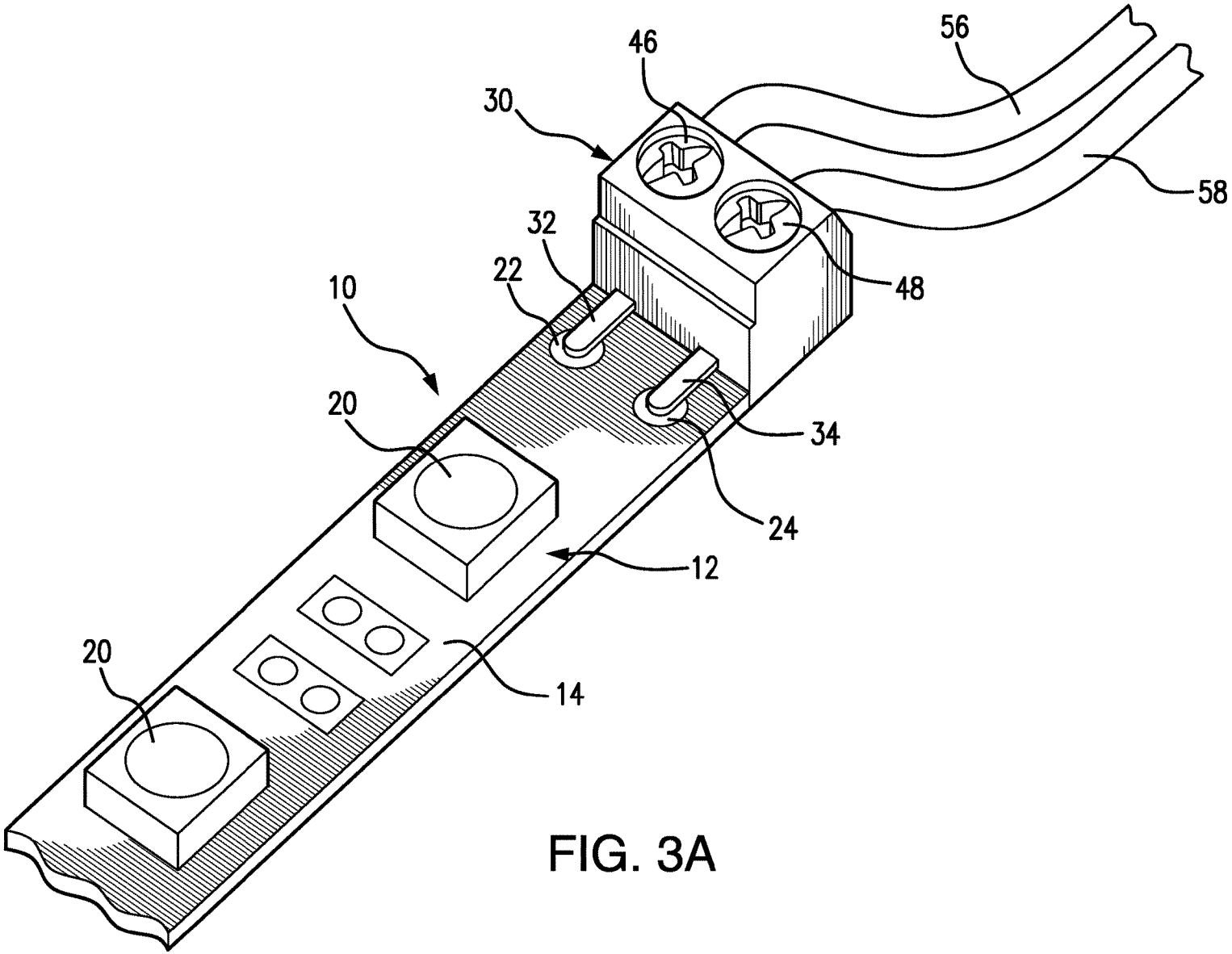
FIG. 3A is a cutaway perspective view of a portion of an LED light strip showing the two-port screw-in terminal connector with wire conductors attached thereto and placed in position at the end of the LED light strip with conductor pins of the screw-in terminal connector in contact with positive and negative conductive contact terminal pads on the LED light strip.
Figure 3B:
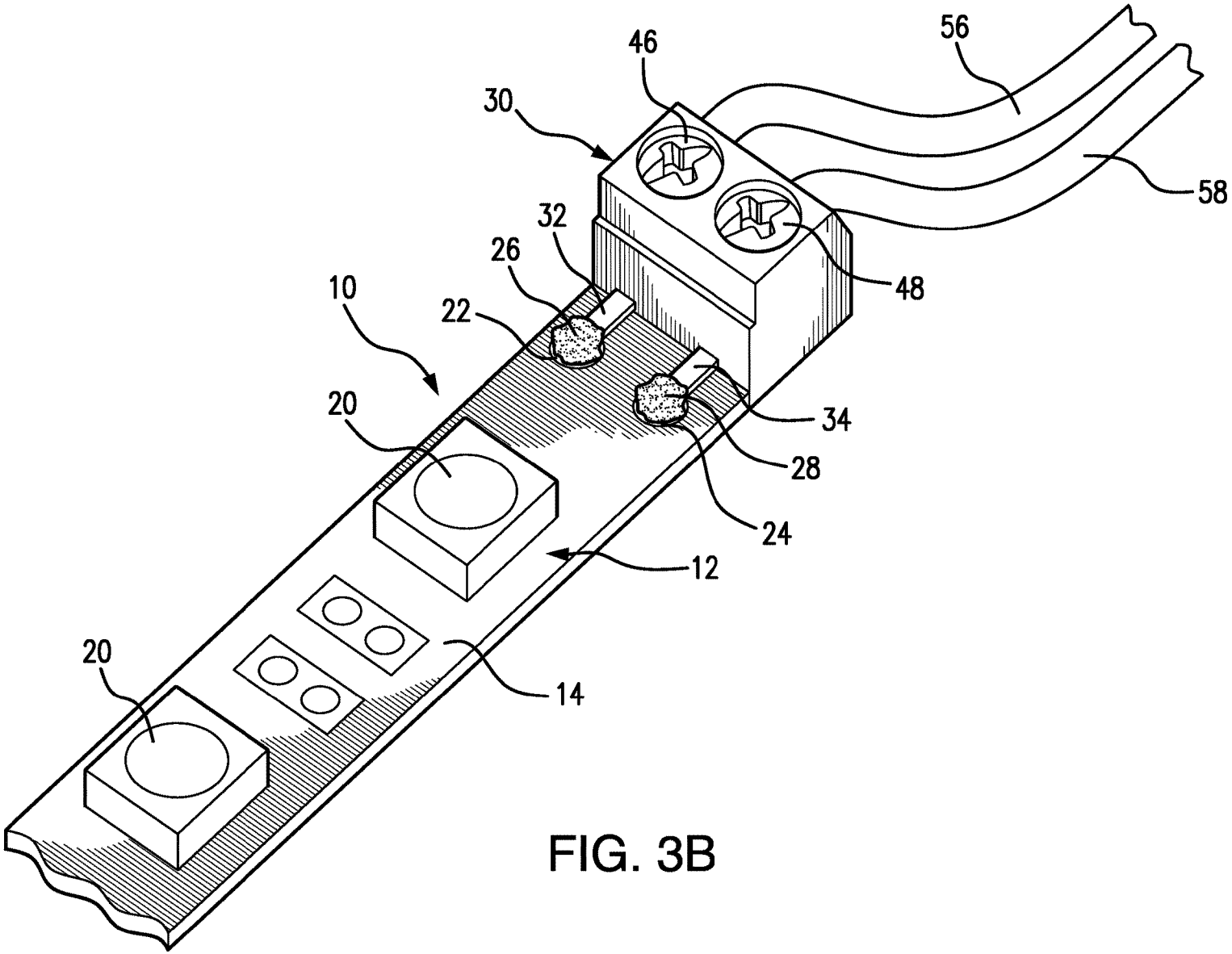
FIG. 3B is a cutaway perspective view of the portion of the LED light strip shown in FIG. 3A and illustrating the conductive pins of the two-port screw-in terminal connector soldered to the positive and negative conductive contact terminal pads on the LED light strip.
Figure 7:
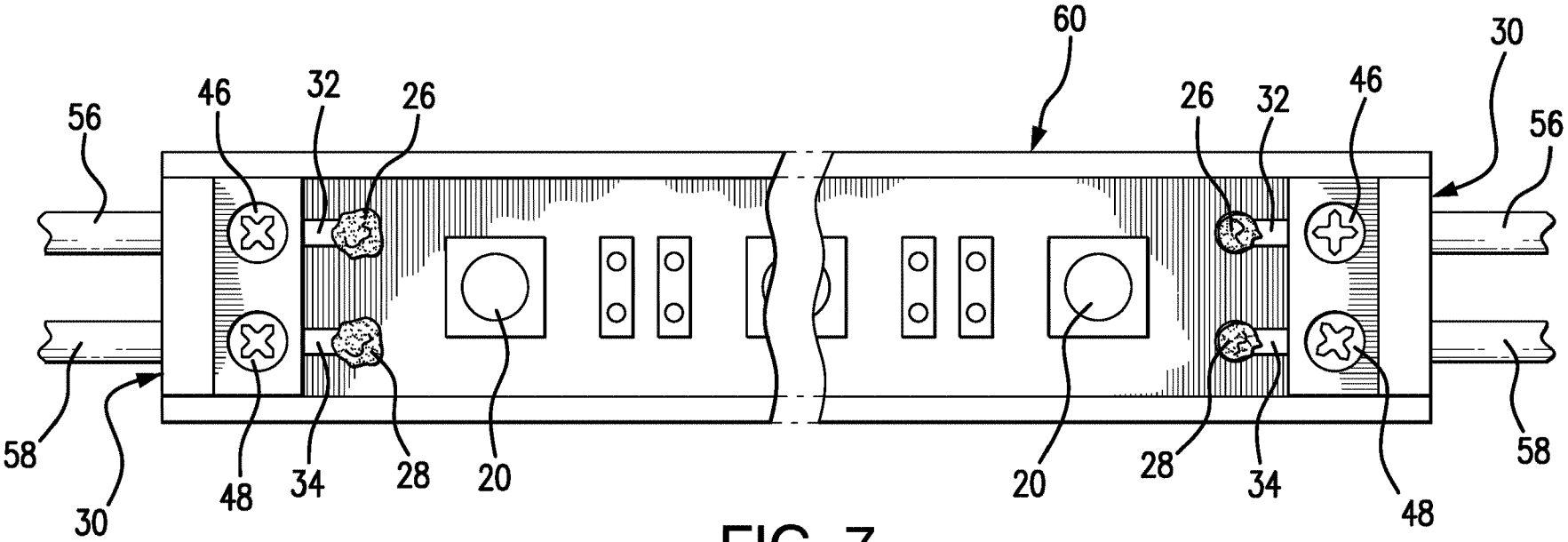
FIG. 7 is a top plan view of the LED light strip of the present invention shown fitted within an extruded channel, wherein the two-port screw-in terminal connectors are provided at each end of the LED light strip and soldered to the conductive terminal contact pads of the light strip and having wire conductors attached to the two-port screw-in terminal connectors.

Referring initially to FIGS. 3A-3B and 7, the LED light strip 10 includes an elongate substrate 12 which may be formed of a flexible or rigid material. Similar to other LED light strips that are well-known in the art, the LED light strip 10 includes a printed circuit board (PCB) embedded within the material substrate 12. Because this is a well-known feature in LED light strips, the PCB and other details of the circuitry are not shown in any great detail in the drawings. The LED light strip 12 of the present invention further includes LEDs or LED light engines 20 arranged at regular spaced intervals on a top side 14 of the elongate substrate strip 12. The LEDs 20 are electrically connected to the PCB circuitry and are in further electrical communication with conductive contact terminal pads 22, 24. The pairs of conductive pads serve as positive (+) and negative (−) contact terminals for receiving electrical power to energize PCB circuitry, and particularly the LEDs 20. To provide a connection to a DC power source, the opposite ends of the LED light strip 10 are provided with two-port screw-in terminal connectors 30 that are permanently attached to the opposite ends of the LED light strip. In particular, as seen in FIG. 3A, the two-port screw-in terminal connector 30 includes terminal pins 32, 34. Terminal pin 32 is placed in electrical contact with conductive pad 22 while terminal pin 34 is positioned in contact with terminal pad 24 on the LED light strip. It has been found that the best way to secure the connection of the two-port screw-in terminal connectors 30 is by soldering the terminal pins 32, 34 to the corresponding conductive pads 22, 24. This is done by first priming the terminal contact pads 22, 24 with a small bead of solder, then making the connection by fully immersing the pins 32, 34 completely within the molten solder until it sets. FIG. 3B shows the soldered connections 26, 28 that effectively secure the connection of the terminal pins 32, 34 to the corresponding copper terminal conductive pads 22, 24.

Figure 1:
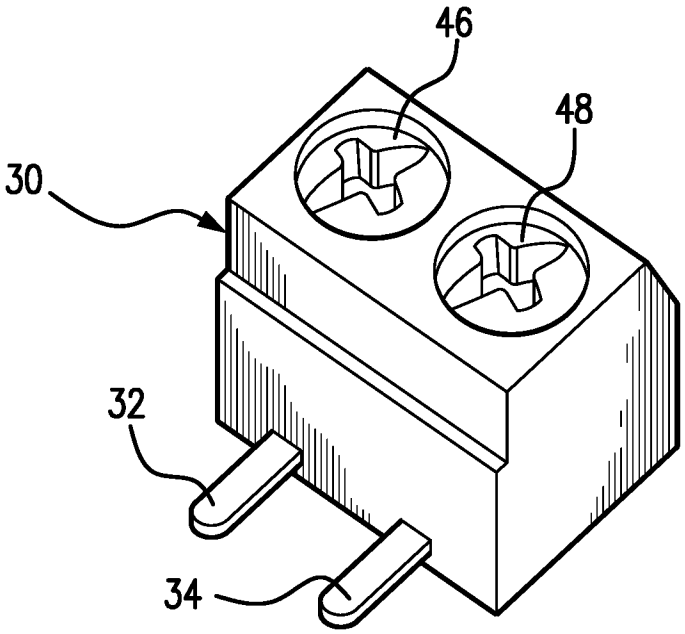
FIG. 1 is a rear top perspective view of a two-port screw-in terminal connector used in the present invention.
Figure 2:
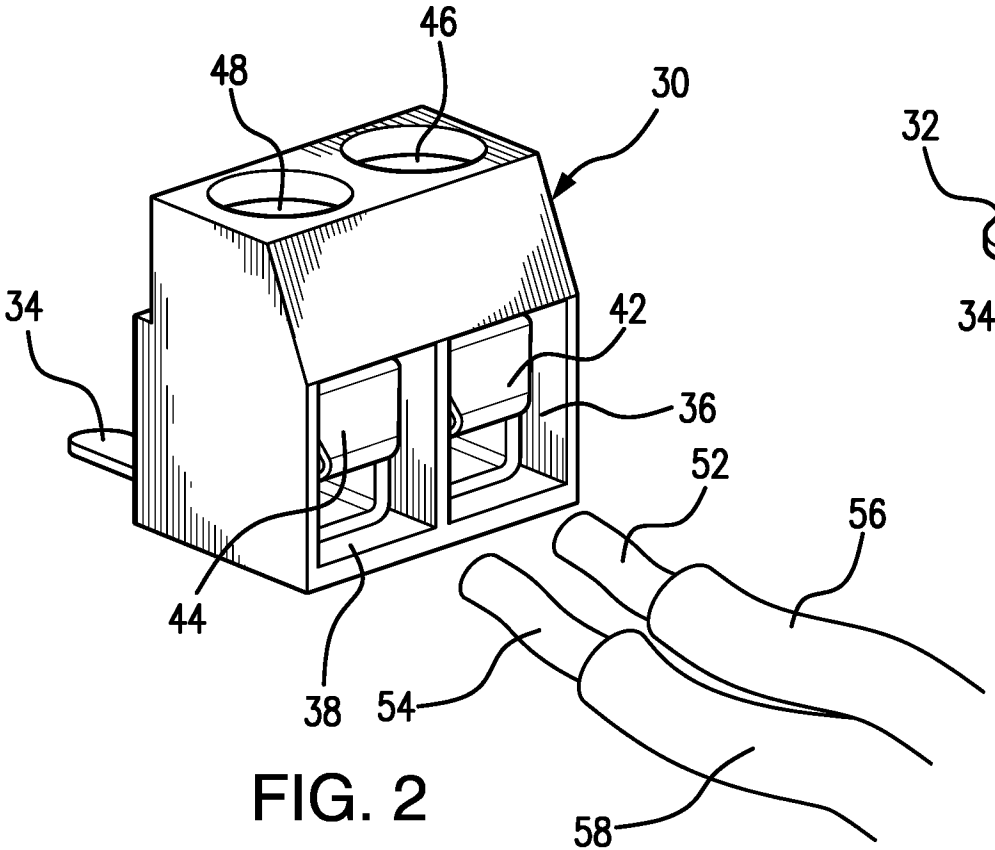
FIG. 2 is a front top perspective view of the two-port screw-in terminal connector illustrating a pair of wire conductors ready to be inserted within corresponding positive and negative terminal screw clamps of the two-port screw-in terminal connector.
Figure 4:
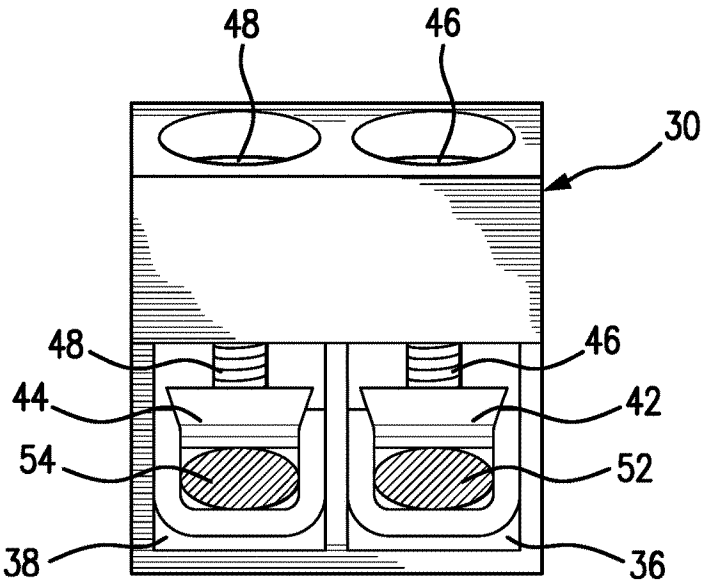
FIG. 4 is a front elevational view of the two-port screw-in terminal connector showing the screw operated terminal screw clamps within the open ports of the terminal connector.
Figure 5:
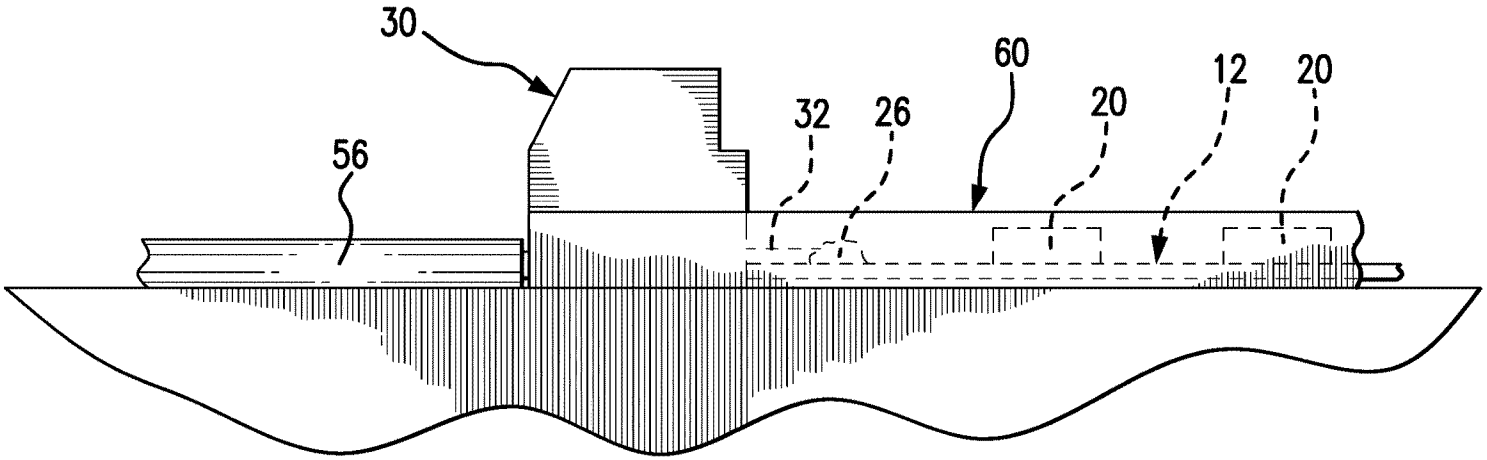
FIG. 5 is a side elevational view, shown in cutaway, illustrating a portion of the LED light strip fitted within an extruded channel and mounted to a surface.

Referring now to FIGS. 1-2 and 4, the two-port screw-in terminal connector 30 that is attached at opposite ends of the LED light strip 12 is shown in more detail. More specifically, each two-port screw-in terminal connector 30 includes terminal connector pins 32, 34. An opposite side of the two-port screw-in terminal connector 30 includes open ports 36, 38, each corresponding with either the positive or negative electrical terminal. The open ports 36, 38 are fitted with screw operated terminal screw clamps 42, 44. Terminal screw clamp 42 is electrically connected, in electric current flow connection with terminal pin 32 on the back side of the screw-in terminal connector 30 while terminal screw clamp 44 is electrically connected in direct electric current flow communication with terminal pin 34. Each of the terminal screw clamps 42, 44 are independently operated by an associated screw 46 or 48 to effectively open and close the screw clamps. More particularly, closing terminal screw clamp 42 is achieved by turning screw 46 on the top of the terminal connector 30 in a clockwise direction to cause the terminal screw clamp 42 to move downwardly towards a bottom conductor portion of the clamp within the open terminal port 36. Loosening or opening of the terminal screw clamp 42 I achieved by turning screw 46 in the opposite (i.e., counterclockwise) direction to cause the upper portion of the screw clamp to move upwardly within the terminal port 36 and away from the bottom conductive element of the screw clamp. Similarly, terminal screw clamp 44 is operated in the same manner by turning screw 48 either clockwise or counterclockwise to either close or open the terminal screw clamp 44. The open terminal ports 36, 38 and associated terminal screw clamps 42, 44 allow for convenient and secure connection of conductive ends 52, 54 of wire conductors 56, 58. As shown in FIG. 2, the conductive ends 52, 54 of the wire conductors have been stripped of their insulation to allow for direct electrical contact with the terminal screw clamps 42, 44. With the terminal screw clamps 42, 44 in the open position, the conductive ends 52, 54 of the wire conductors 56, 58 are received within the associated terminal screw clamps 42, 44 and then, once fully inserted, the screw 46 and 48 are turned in order to close the terminal screw clamps 42, 44 that are already onto the conductive ends 52, 54 of the wire conductors 56, 58 to effectively sandwich the conductive ends 52, 54 within the terminal screw clamps 42, 44 and in electrical connection therewith, as shown in FIG. 4. This provides an excellent and highly secure and reliable electrical connection of the wire conductors 56, 58 to the two-port screw-in terminal connectors 30 and the PCB circuitry of the LED light strips, via the soldered terminal pins 32, 34 to the copper terminal contact pads 22, 24.

Figure 6:
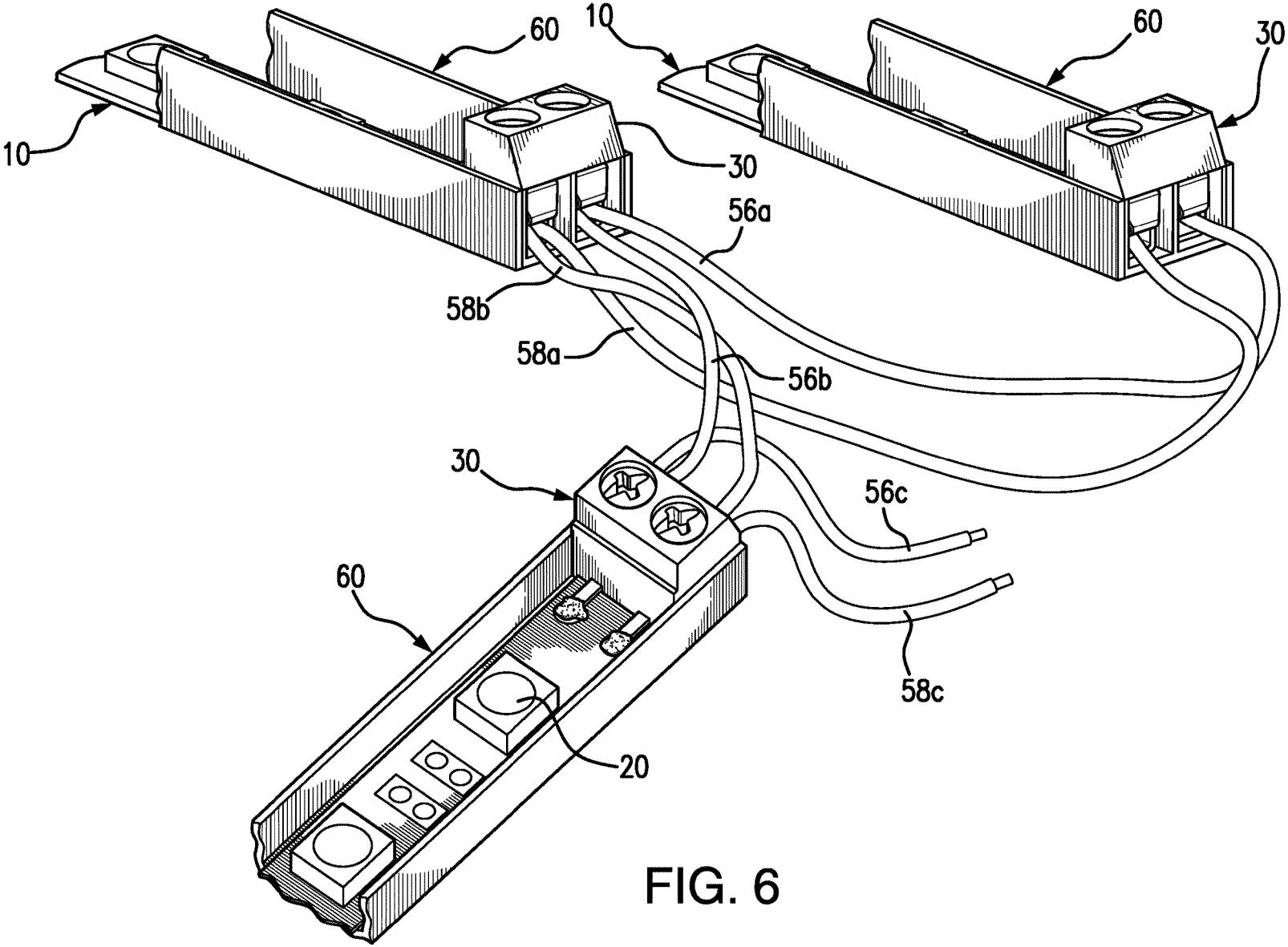
FIG. 6 is a perspective view illustrating three LED light strips of the present invention interconnected in parallel, wherein the terminal end of one of the LED light strips is electrically connected to two other LED light strips using the two-port screw-in terminal connectors and interconnecting wire conductors.

Referring to FIGS. 6 and 7, the LED light strips 10 are shown within an extruded channel 60. Extruded channels of this type are well-known in the art and may be made out of metal, such as aluminum, or plastic. The extruded channels 60 of this nature allow for a cleaner, more, more neat appearance of the LED strip lighting fixture as well as allowing for easier mounting and insulation.

As seen in FIG. 6, the two-port screw-in terminal connectors 30 of the present invention allow for splitting off with multiple wire connections in parallel from the end of one LED light strip to two or more LED light strips and/or a DC power supply source. As seen in FIG. 6, wire conductors 56A and 58A extend from the positive and negative terminals of one terminal connector 30 on one of the LED light strips to another terminal connector 30 of a second LED light strip. Moreover, wire conductors 56B and 58B can extend from the one terminal connector 30 of the one LED light strip to yet a third LED light strip, as seen in FIG. 6. And from that the terminal connector 30 of that third LED light strip, wire conductors 56C and 58C can be connected to the terminal connector and to a 12 volt or 24 volt DC power source or an additional LED light strip.

Figure 8:
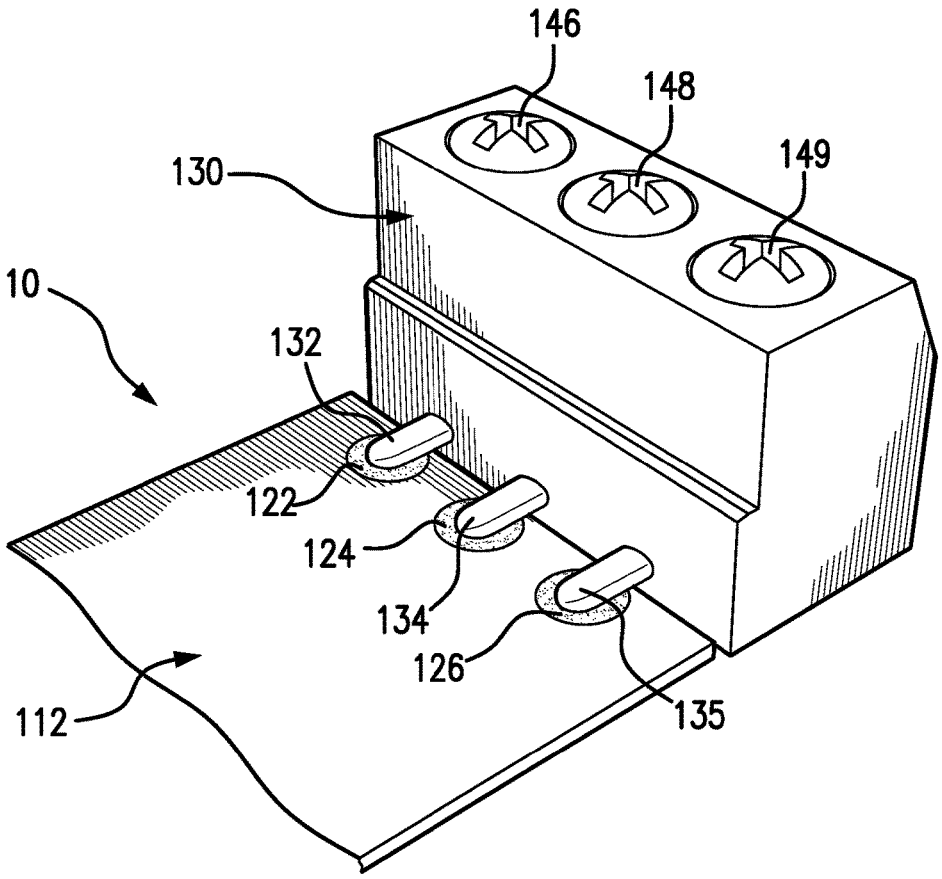
FIG. 8 is a cutaway rear perspective view of a portion of an LED light strip showing a three-port screw-in terminal connector attached thereto and placed in position at the end of the LED light strip with the conductor pins of the screw-in terminal connector in contact with conductive contact terminal pads on the LED light strip, including a positive contact pad, a negative contact pad and a data contact pad.
Figure 9:
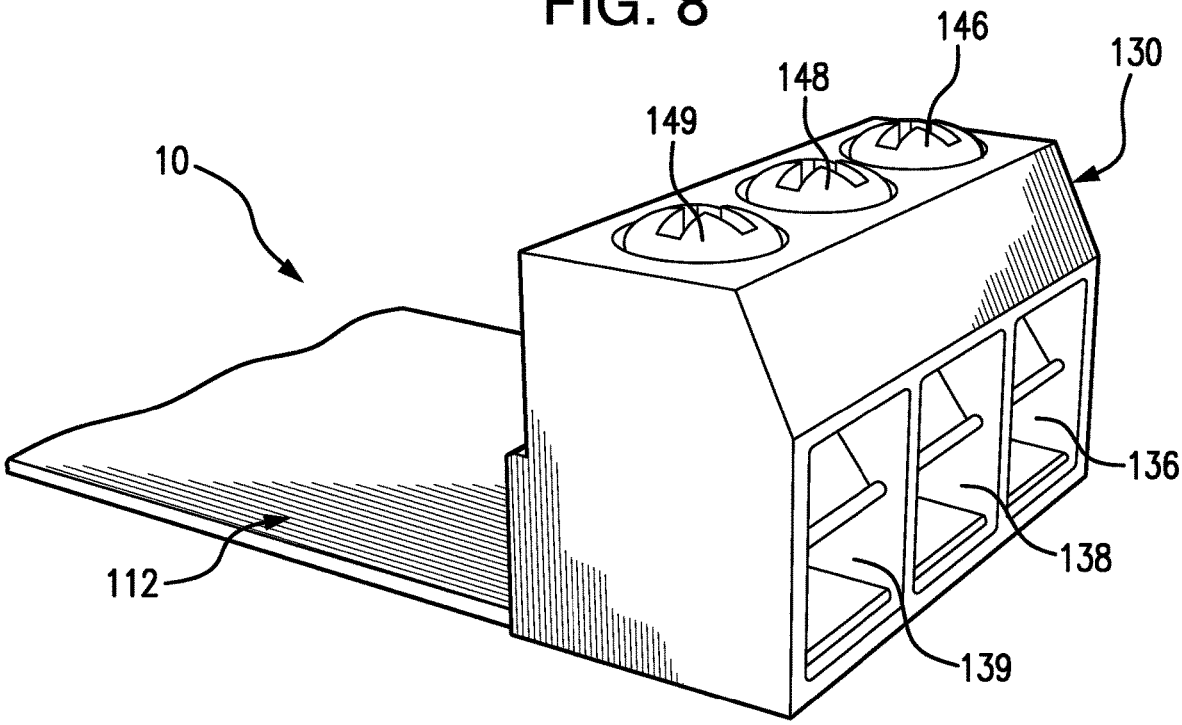
FIG. 9 is a cutaway front perspective view of the three-port screw-in terminal connector and LED light strip of FIG. 8.

Another embodiment of the invention directed to a three-port screw-in terminal connector 130 is shown in FIGS. 8 and 9. As seen in FIG. 8, the three-port screw-in terminal connector 130 includes terminal connector pins 132, 134 and 135. An LED light strip 112 is shown and includes terminal contact pads 122, 124 and 126. In this particular embodiment, the terminal pins 132, 134 and 135 are each soldered to a corresponding one of the conductive contact pads 122, 124 and 126. For example, terminal pin 132 and contact pad 122 may be the positive terminal, while terminal pin 134 and conductive contact pad 124 may be the negative terminal of the DC power connection. The conductive contact pad 126 and terminal pin 135 soldered thereto may provide for a data connection. As seen in FIG. 9, the terminal connector 130 includes open ports 136, 138 and 139 which allow for easy connection of wire conductors, as described above in connection with the embodiment of FIGS. 1-7. Each port 136, 138 and 139 is provided with a screw clamp, as described above, which are tightened (i.e., closed) and opened by operation of associated screws 146, 148 and 149, respectively.

Figure 10:
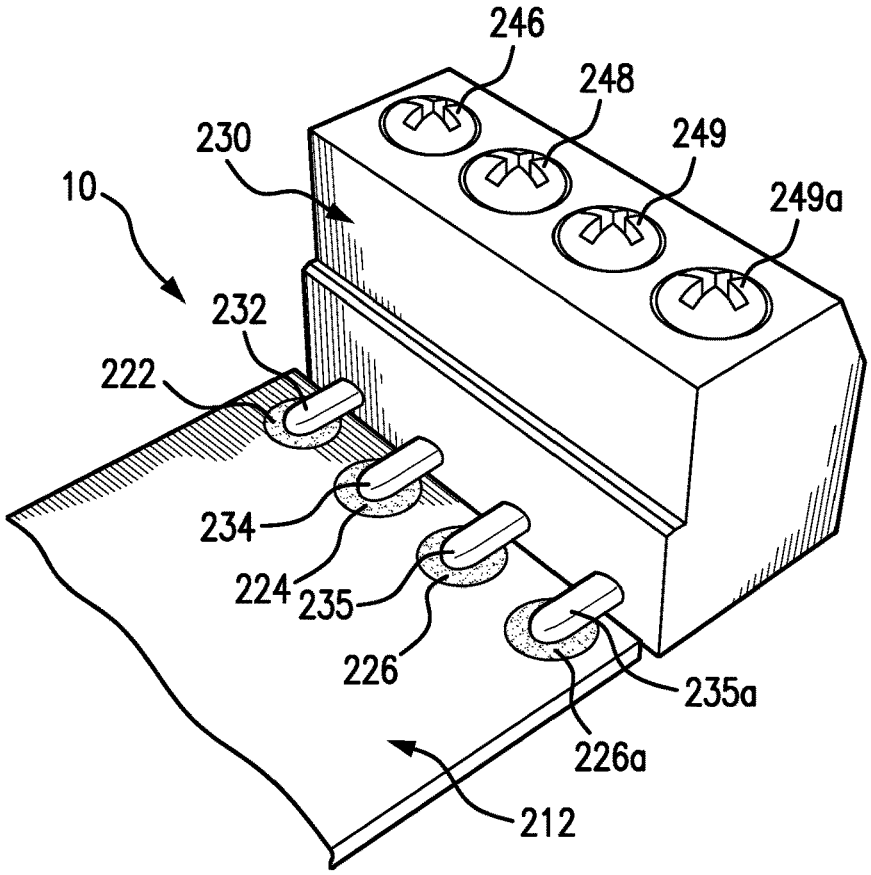
FIG. 10 is a cutaway rear perspective view of a portion of an LED light strip showing a four-port screw-in terminal connector placed in position at the end of the LED light strip with conductor pins of the four-port screw-in terminal connector in contact with corresponding conductive contact terminal pads on the LED light strip, such as, for example, a positive terminal, and RGB terminal contacts.
Figure 11:
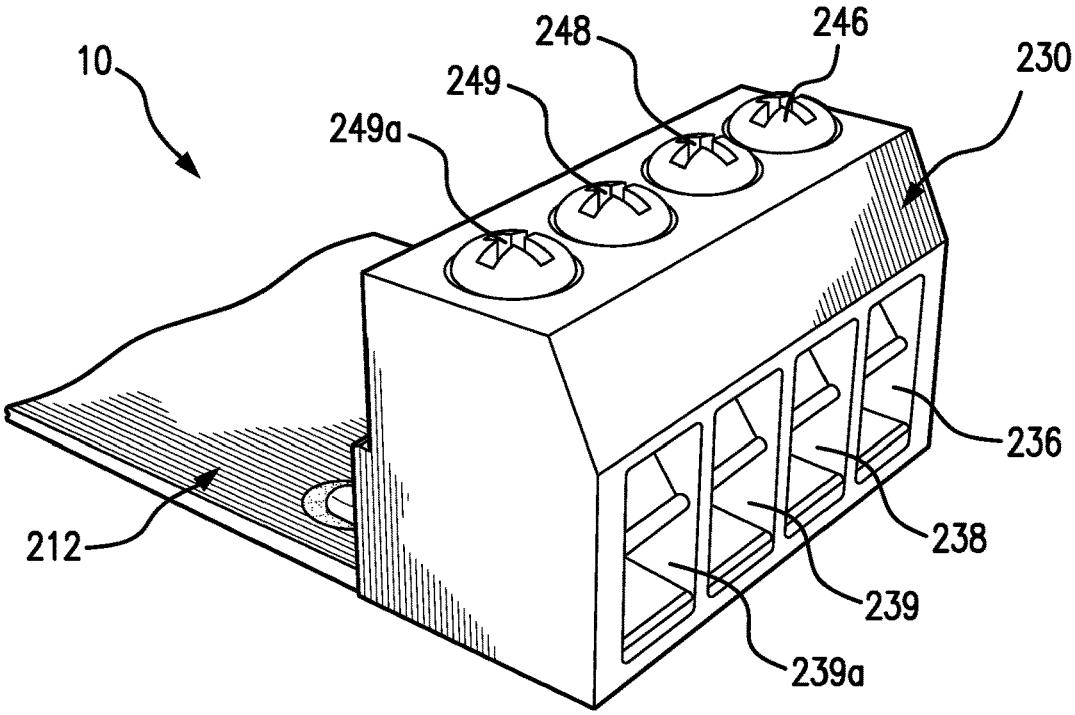
FIG. 11 is a cutaway front perspective view of the four-port screw-in terminal connector and LED light strip of FIG. 10.

Referring to FIGS. 10 and 11, a further embodiment of the present invention is shown and includes an LED light strip 212 having four terminal contact pads 222, 224, 226 and 226*a*, along with a four-port terminal connector 230 having terminal pins 232, 234, 235 and 235*a* for soldered connection with the correspondingly positioned contact pads on the LED light strip 212, as seen in FIG. 10. The opposite side of the terminal connector 230 is provided with four open ports 236, 238, 239 and 239*a*, each having a terminal screw clamp therein, as described in connection with the embodiment of FIGS. 1-7 above. Operation of the terminal screw clamps in each open port, to open or close the screw clamps, is achieved through turning the screws 246, 248, 249 and 249*a*, in either the clockwise or counterclockwise direction, as described above.

Figure 12:
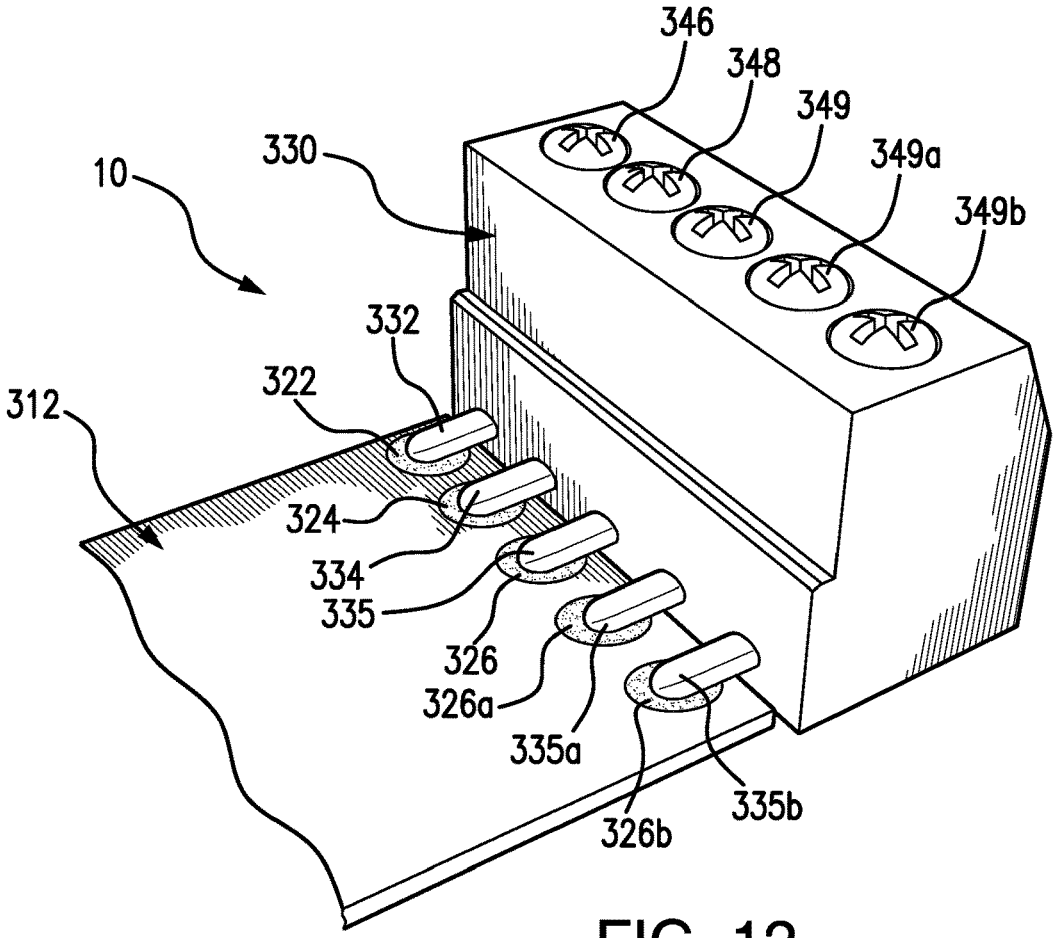
FIG. 12 is a cutaway rear perspective view of a portion of an LED light strip showing a five-port screw-in terminal connector placed in position at the end of the LED light strip with conductor pins of the five-port screw-in terminal connector in contact with corresponding conductive contact terminal pads on the LED light strip, such as, for example, a positive conductive contact pad, RGB contact pads and a white LED terminal contact pad.
Figure 13:
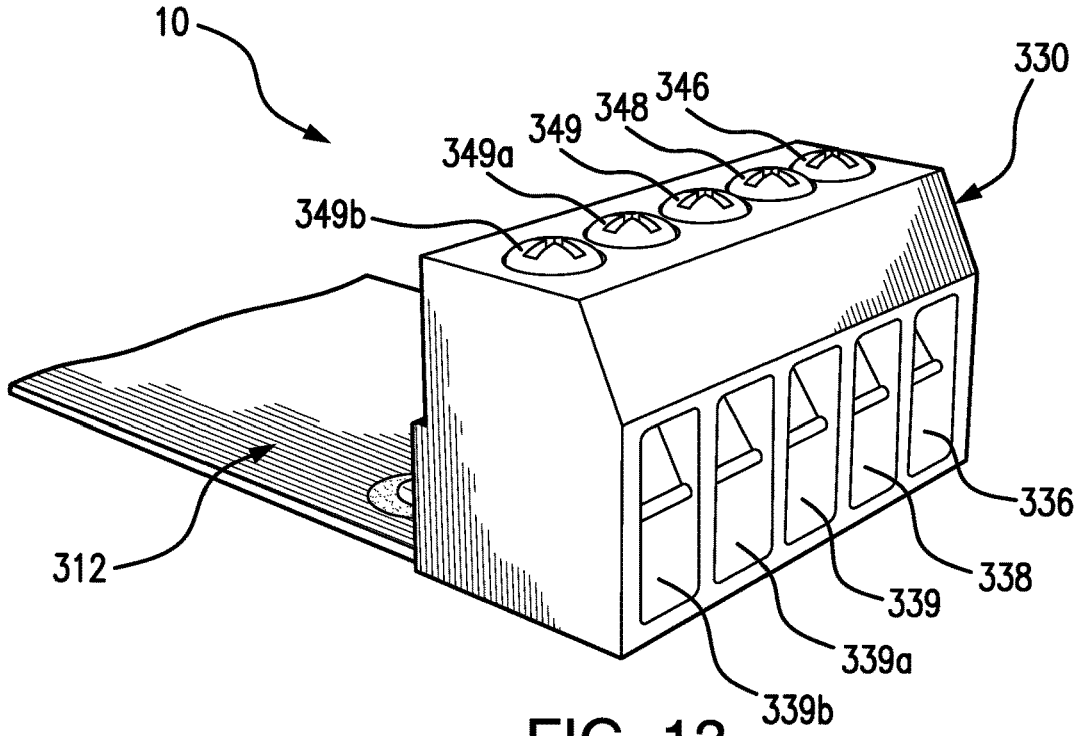
FIG. 13 is a cutaway front perspective view of the five-port screw-in terminal connector and LED light strip of FIG. 12.

Finally, a further embodiment of the invention is shown in FIGS. 12-13 wherein an LED light strip 312 includes five conductive contact pads 322, 324, 326, 326*a* and 326*b*. A five-port screw-in terminal connector 330 has terminal pins 332, 334, 335, 335*a* and 335*b* for soldered connection with the correspondingly positioned terminal contact pads on the LED light strip 312, as seen in FIG. 12.

Referring to FIG. 13, the opposite side of the five-port terminal connector 330 includes five open ports 336, 338, 339, 339*a* and 339*b* each having a terminal screw clamp therein, as described above in connection with the embodiment of FIGS. 1-7. Operation of each terminal screw clamp within each of the open ports, to open or close each screw clamp, is achieved by turning the associated screws 346, 348, 349, 349*a* and 349*b* in either the clockwise or counterclockwise direction, as described above in connection with the embodiment of FIGS. 1-7.

While the present invention has been shown and described in accordance with several preferred and practical embodiments, it is recognized that departures from the instant disclosure are fully contemplated within the spirit and scope of the present invention which is not to be limited except as defined in the following claims as interpreted under the Doctrine of Equivalents.

What is claimed is:

1. An LED light strip comprising:

an elongated substrate having a first side, an opposite second side, a first end, an opposite second end, a plurality of conductive traces, and two or more conductive terminal contact pads on the first side adjacent each end of the substrate and electrically connected to the plurality of conductive traces;

a plurality of LEDs arranged at regular spaced intervals on the first side of the substrate and electrically connected with one or more of the plurality of conductive traces in the substrate; and a screw-in terminal connector at each end of the substrate and maintained in abutting engagement with the respective first and second ends and flush with the second side of the substrate, and including two or more straight conductive pins extending from a first side of the terminal connector, each conductive pin soldered in electrical contact to a respective one of the conductive terminal contact pads at each end of the substrate, each terminal connector further including two or more open ports on an opposite second side of the terminal connector and each open port in linear alignment with one of the conductive pins, each open port containing a terminal screw clamp configured for receiving a terminal end of at least one conductor wire therein so that the at least one conductor wire can extend straight out from the open port and coplanar with the substrate, wherein the terminal screw clamps are operated by an associated screw for closing the terminal screw clamp, sandwiching the terminal end of the at least one conductor wire, and connecting the plurality of LEDs to an electric power supply.

* * * * *